US005306097A

United States Patent [19]

Kaneko

[11] Patent Number: 5,306,097

[45] Date of Patent: Apr. 26, 1994

[54] INK RIBBON CASSETTE AND RECORDING APPARATUS USING ELECTRODE GROUND

[75] Inventor: Masanori Kaneko, Kawasaki, Japan

[73] Assignee: Canon Kabushiki Kaisha, Tokyo, Japan

[21] Appl. No.: 95,370

[22] Filed: Jul. 9, 1993

Related U.S. Application Data

[63] Continuation of Ser. No. 608,533, Nov. 2, 1990, abandoned.

[30] Foreign Application Priority Data

Nov. 2, 1989 [JP] Japan ..... 1-284885
Oct. 30, 1990 [JP] Japan ..... 2-290715

[51] Int. Cl.[5] ..... B41J 3/02; B41J 35/28

[52] U.S. Cl. ..... 400/120; 400/208; 400/241.1; 346/76 PH

[58] Field of Search ..... 400/196, 208, 237, 241, 400/241.1, 241.4, 120; 242/197, 198; 346/76 PH

[56] References Cited

U.S. PATENT DOCUMENTS

| | | | |
|---|---|---|---|
| 4,329,071 | 5/1982 | Applegate et al. | 400/120 |
| 4,491,431 | 1/1985 | Aviram et al. | 400/241.1 |
| 4,603,337 | 1/1986 | Erlichman | 400/120 |
| 4,692,044 | 9/1987 | Aviram et al. | 400/120 |
| 4,744,685 | 5/1988 | Mecke et al. | 400/241.4 |
| 4,798,483 | 1/1989 | Inaba | 400/120 |
| 4,810,119 | 3/1989 | Afzah-Ardavani | 400/120 |
| 4,897,668 | 1/1990 | Nagato et al. | 400/120 |
| 4,938,617 | 7/1990 | Mecke et al. | 400/241.4 |
| 5,005,993 | 4/1991 | Ohno et al. | 400/120 |
| 5,008,683 | 4/1991 | Suzuki | 400/208 |
| 5,063,394 | 11/1991 | Nagato | 400/120 |

FOREIGN PATENT DOCUMENTS

| | | | |
|---|---|---|---|
| 0057759 | 8/1982 | European Pat. Off. | 400/120 |
| 3445435 | 7/1985 | Fed. Rep. of Germany | 400/208 |
| 0106985 | 6/1984 | Japan | 400/208 |
| 0012385 | 1/1986 | Japan | 400/208 |
| 0012386 | 1/1986 | Japan | 400/208 |
| 0158489 | 7/1986 | Japan | 400/208 |
| 0167592 | 7/1986 | Japan | 400/691 |
| 1189978 | 8/1986 | Japan | 400/208 |
| 0290082 | 12/1986 | Japan | 400/208 |
| 0115770 | 5/1988 | Japan | 400/208 |
| 0115771 | 5/1988 | Japan | 400/208 |
| 0154375 | 6/1988 | Japan | 400/208 |
| 0159079 | 7/1988 | Japan | 400/208 |
| 2114954 | 9/1983 | United Kingdom | 400/208 |

*Primary Examiner*—Eugene H. Eickholt
*Attorney, Agent, or Firm*—Fitzpatrick, Cella, Harper & Scinto

[57] ABSTRACT

An ink ribbon cassette and a recording apparatus adapted to detachably attach the ink ribbon cassette thereto. An electrode for dissipating electrical charges on the ink ribbon surface is provided either in the ink ribbon cassette or on a carrier of the recording apparatus. The electrode can comprise a resilient conductive member, such as a ground plate having an end portion that is bent into a V-shape. In addition, the electrode may be provided with sharp projections adapted to make scratches on the ink ribbon surface. The electrode is adapted to be brought into contact with the ink ribbon surface either before or after the ink ribbon is used for thermal recording. The electrode forms a path through which charge on the ribbon can be dissipated even if the surface layer of the ribbon is an insulator.

34 Claims, 5 Drawing Sheets

INK RIBBON CASSETTE AND RECORDING APPARATUS USING ELECTRODE GROUND

This application is a continuation of application Ser. No. 07/608,533 filed Nov. 2, 1990, now abandoned.

BACKGROUND OF THE INVENTION

1. Field of the Invention

This invention relates to an ink ribbon cassette and a recording apparatus to which this ink ribbon cassette can be attached. More specifically, this invention relates to an ink ribbon cassette equipped with an ink ribbon, and to a recording apparatus which is adapted to perform recording by transferring ink from this ink ribbon to a recording medium.

2. Description of the Related Art

In a conventional thermal transfer recording apparatus, it may happen, after it has been used for a long period of time, that the electrodes of the recording head suffer damage, with the result that electricity cannot be supplied to the associated heat generating resistors. This is considered to be attributable to the fact that the ink ribbon is charged as a result of its being in contact with the recording head; this charge flows to the recording head, causing an electrochemical reaction to occur in the head electrode section, which causes the head electrodes to corrode and, consequently, become destroyed. Conventionally, this has been avoided by allowing the above-mentioned charge to flow from the ink side of the ink ribbon. For this purpose, an electrode is held in contact with the ink ribbon at a position on the supply reel side with respect to the recording head. Nowadays, however, a variety of functions are required of the ink ribbon; for example, printing has to be performed in two colors with a single ink ribbon, or printing and erasing have to be effected with a single ink ribbon. Accordingly, a number of ink layers have to be provided on the base film of the ink ribbon. With such an arrangement, the surface portion of the thermal transfer ink layer is not always a conductor; it can be an insulator in some cases. If the surface layer of the thermal transfer ink layer is an insulator, no current path can be formed between the ink ribbon and the above-mentioned electrode, so that the recording head cannot be protected from destruction.

SUMMARY OF THE INVENTION

It is an object of this invention to provide an ink ribbon cassette and a recording apparatus which are capable of effecting clear recording.

Another object of this invention is to provide an ink ribbon cassette and a recording apparatus in which any charge on the ink can be removed.

Still another object of this invention is to provide an ink ribbon cassette and a recording apparatus in which any charge on the ink ribbon can be removed even if the surface portion on the ink layer side of the ink ribbon consists of an insulating layer.

A further object of this invention is to provide an ink ribbon cassette and a recording apparatus which make it possible to prevent the recording head from being destroyed.

A still further object of this invention is to provide an ink ribbon cassette and a thermal recording apparatus in which any charge on the ink ribbon due to friction between the ink ribbon and the head can be removed even if an insulating layer is formed on the ink layer side of the ribbon.

According to one aspect, the present invention which achieves these objectives relates to an ink ribbon cassette adapted to be attached to a recording apparatus. The ink ribbon cassette comprises an ink ribbon having an ink layer and an insulating surface layer, first and second winding sections around which the ink ribbon can be wound, and a conductive member adapted to be brought into contact with the ink ribbon. When the ink ribbon cassette is attached to the recording apparatus, the ink ribbon is subjected to a recording action from the recording apparatus. The insulating surface layer can have a volume resistivity of $10^{13}$ to $10^{17}$ Ωcm. In addition, the conductive member can have an electrical resistance of no greater than 1kΩ, 100Ω, or 10Ω. The conductive member comprises means for grounding the ink ribbon when the ink ribbon cassette is attached to the recording apparatus. The conductive member is positioned to engage a conductive member in the recording apparatus when the ink ribbon cassette is attached to the recording apparatus.

According to still another aspect, the present invention relates to a recording apparatus for performing recording on a recording medium. The apparatus comprises an attachment section which allows the attachment of an ink ribbon cassette including an ink ribbon having an ink layer and an insulating surface layer, first and second winding sections around which the ink ribbon can be wound and a conductive member adapted to be in contact with the ink ribbon which, when attached to the recording apparatus, is subjected to a recording action therefrom. The recording apparatus further comprises recording means for performing recording on the ink ribbon of the ink ribbon cassette attached to the attachment section, and feeding means for feeding the recording medium.

The attachment section allows of an ink ribbon cassette having an ink ribbon the insulating surface layer of which has a volume resistivity of $10^{13}$ to $10^{17}$Ωcm. In addition, the attachment section allows attachment of an ink ribbon cassette having a conductive member, the electrical resistance of which is no greater than 1kΩ, 100Ω, or 10Ω. The attachment section comprises a conductive element positioned to contact the conductive member of the ink ribbon cassette when the attachment section attaches the ink ribbon cassette to the recording apparatus. The conductive element comprises means for grounding the ink ribbon when the attachment section attaches the recording apparatus to the ink ribbon cassette. In addition, the attachment section comprises means for grounding the ink ribbon when the attachment section attaches the recording- apparatus to the ink ribbon cassette.

According to still another aspect, the present invention relates to a thermal recording apparatus for performing recording by heating an ink ribbon having a base film, an ink layer, and an insulating surface layer. The thermal recording apparatus comprises a recording apparatus body having a frame, a thermal head for heating a portion of the the ink ribbon for recording, and an electrode for dissipating electrical charges which is arranged to come into contact with that portion of the ink layer of the ink ribbon which has been used for recording by the thermal head. In this embodiment the electrode can have an electrical resistance of no greater than 1kΩ, 100 Ω, or 10Ω. The electrode is grounded to the frame of the recording apparatus body. In addition, the ink ribbon is housed in a detachable ink ribbon cassette and the thermal recording apparatus comprises means for detachably attaching the detachable ink ribbon cassette. In addition, the electrode is arranged in the detachable ink ribbon cassette.

According to still another aspect, the present invention relates to a thermal recording apparatus for performing recording by heating an ink ribbon having a base film, an ink layer, and an insulating surface layer. The thermal recording apparatus comprises a thermal head for heating the ink ribbon, and an electrode for dissipating electrical charges which is adapted to come into contact with the ink layer before and after the ink layer is used for recording by the thermal head. The electrode can comprise means for grounding the ink ribbon when contacting the ink layer. Specifically, the electrode can comprise a ground plate having a V-shaped end portion, the crest of which comprises a plurality of projections.

According to still another aspect, the present invention relates to a thermal recording apparatus for performing recording by heating an ink ribbon having a base film, an ink layer, an insulating surface layer, and a conductive layer. The thermal recording apparatus comprises a thermal head for heating the ink ribbon. The thermal head is adapted to come into contact with the conductive layer. The apparatus further comprises an electrode for dissipating electrical charges, which is adapted to be brought into contact with the conductive layer. The ink ribbon is housed in an ink ribbon cassette. The apparatus can further comprise a carrier for supporting the thermal head and the electrode. The electrode can comprise a ground spring projecting from the carrier into contact with the conductive layer when the carrier is attached to the ink ribbon cassette. In this embodiment the electrode can have an electrical resistance of no greater than 1kΩ, 100Ω, or 10Ω.

According to still another aspect, the present invention relates to an ink ribbon cassette for attachment to a recording apparatus which performs recording on a recording medium. The ink ribbon cassette comprises an ink ribbon having an insulating surface layer, first and second winding sections around which the ink ribbon can be wound, and an electrode for dissipating electrical charges which is arranged in such a manner as to come into contact with the ink surface of that portion of the ink ribbon which is between the first and second winding sections. The electrode can comprise means for grounding the ink ribbon when the ink ribbon cassette is attached to the recording apparatus.

According to still another aspect, the present invention relates to a recording apparatus adapted to perform recording on a recording medium, comprising a recording apparatus body and an attachment section which allows detachable attachment of an ink ribbon cassette including an ink ribbon having an ink layer and an insulating surface layer, first and second winding sections around which the ink ribbon can be wound, and an electrode for dissipating electrical charges which is arranged in such a manner as to come into contact with the surface of that portion of the ink layer of the ink ribbon which is between the first and second winding sections. The recording apparatus further includes an apparatus body side electrode adapted to abut against the electrode of the ink ribbon cassette and to dissipate electrical charges on the ink ribbon when the attachment section is attached to the ink ribbon cassette. The recording apparatus further comprises a recording head which can act on the ink ribbon in the ink ribbon cassette when the ink ribbon cassette is attached to the attachment section, and feeding means for feeding the recording medium. The electrode can have an electrical resistance of no greater than 1kΩ, 100Ω, or 10Ω.

BRIEF DESCRIPTION OF THE DRAWINGS

FIG. 7(*b*) is a perspective view of the ground plate of FIG. 7(*a*) entering a slot 12*b* in the ribbon cassette 100.

DETAILED DESCRIPTION OF THE PREFERRED EMBODIMENTS

Embodiment 1

Figure 1:
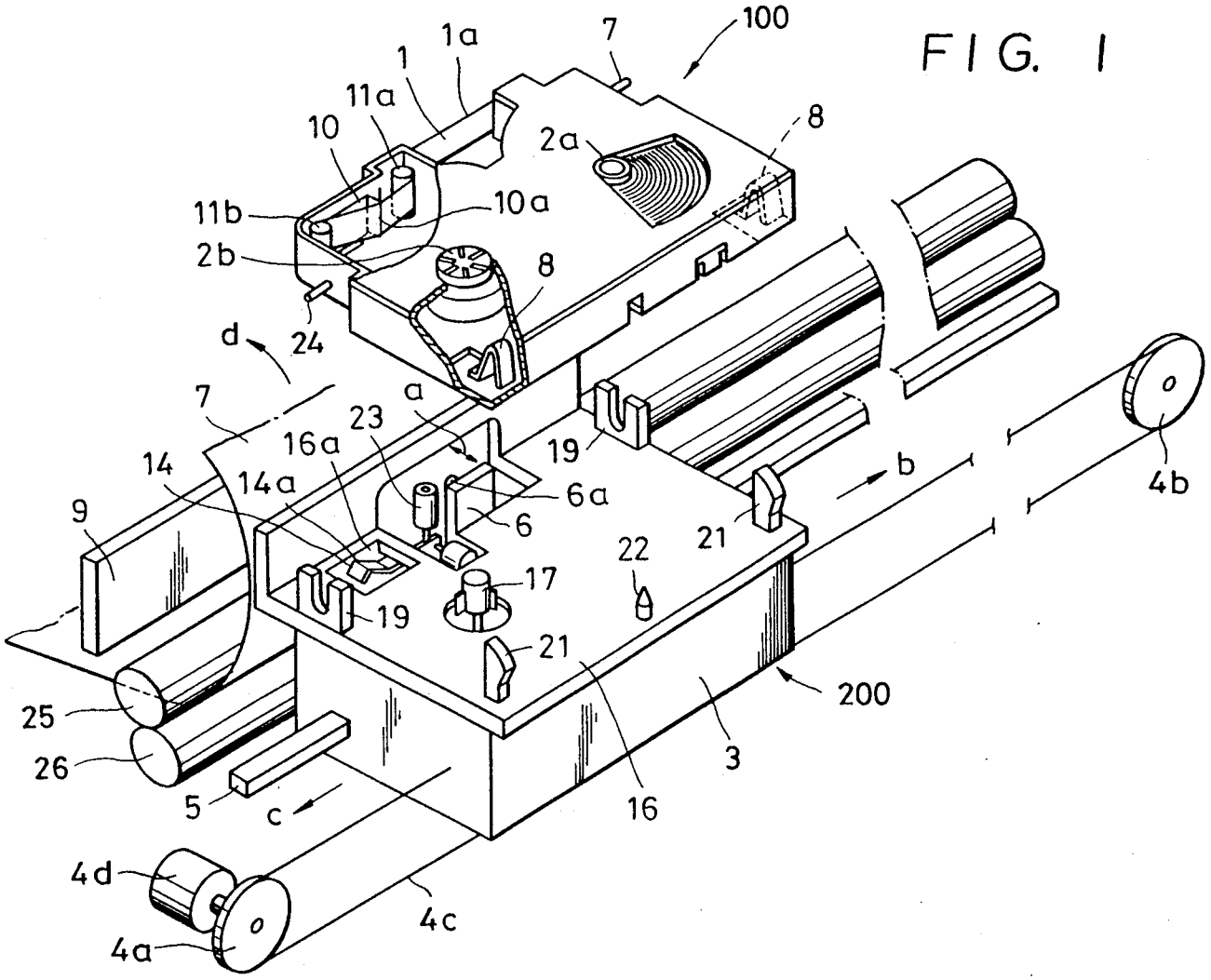
FIG. 1 is a perspective view of an embodiment of the thermal recording apparatus of this invention.
Figure 3:
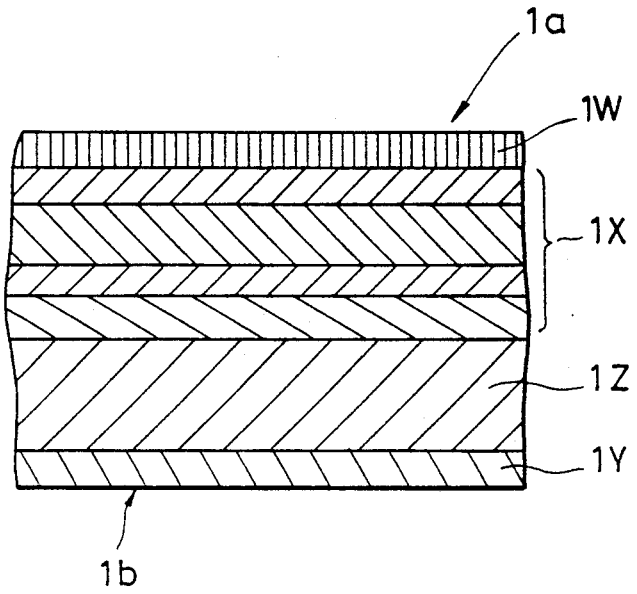
FIG. 3 is a sectional view of an ink ribbon applicable to this embodiment.

FIG. 1 is a perspective view showing a thermal transfer recording apparatus and an ink ribbon cassette in accordance with this invention. First, the mechanism of the thermal recording apparatus will be schematically described with reference to FIG. 1. The reference numeral 100 indicates the ink ribbon cassette in which a thermal transfer ink ribbon 1, whose construction is shown in FIG. 3, is lodged. Within the ink ribbon cassette 100, the ink ribbon 1 is wound around a supply reel 2*a* and a take-up reel 2*b*. The reference symbol 200 indicates the body of the thermal transfer recording apparatus, which consists of a serial-type image recording apparatus for performing thermal transfer recording. The body of the recording apparatus 200 includes a carrier 3, to which the cassette 100 is detachably attached, and pulleys 4*a*, 4*b*, between which a belt 4*c* is stretched. The carrier 3 engages this belt 4*c*. As a carrier motor 4*d*, which is linked with the pulley 4*a*, rotates in two opposite directions, the carrier 3 reciprocates in the directions indicated by arrows b and c.

Mounted on the carrier 3 is a printing head 6, on which are arranged longitudinally a plurality of heat generating elements 6*a*, which are adapted to generate heat individually in response to image signals. This head 6 is adapted to make a swinging movement as indicated by arrow a by means of a torque obtained from the rotation of a rectangular torque shaft 5, which is effected by a motor or the like (not shown). When the motor rotates in, for example, the normal direction, the printing head 6 is lowered, causing the ink layer side of the ink ribbon 1 to be pressed against a recording paper sheet 7, which is supported by a platen 9. When the motor rotates in, for example, the reverse direction, the head 6 is raised and separated from the ink ribbon 1. When the carrier 3 runs in the direction indicated by the arrow b, with the printing head 6 in the lowered position, the ink ribbon 1 is successively let out from the supply reel 2*a*. During recording, the printing head 6 generates heat in synchronism with the running of the carrier, in accordance with image signals from a control section (not shown). Each time a recording is completed for one line, the recording head 6 is raised and the carrier 3 returns to a home position. At the same time, paper feeding rollers 25, 26 are driven, feeding the recording paper sheet 7 in the direction indicated by arrow d by a distance corresponding to one line, the printing of the next line being performed in the same manner as described above.

When detachably attaching the cassette 100 to the carrier 3, engaging pins 24, formed on the cassette 100, are fitted into corresponding engagement sections 19 formed on the carrier 3. At the same time, projections 21, formed on the carrier 3, are likewise fitted into corresponding recesses 8 formed in the cassette 100. The reference numerals 22 and 23 indicate a positioning pin and a guide roller, respectively, on the carrier 3.

Figure 2:
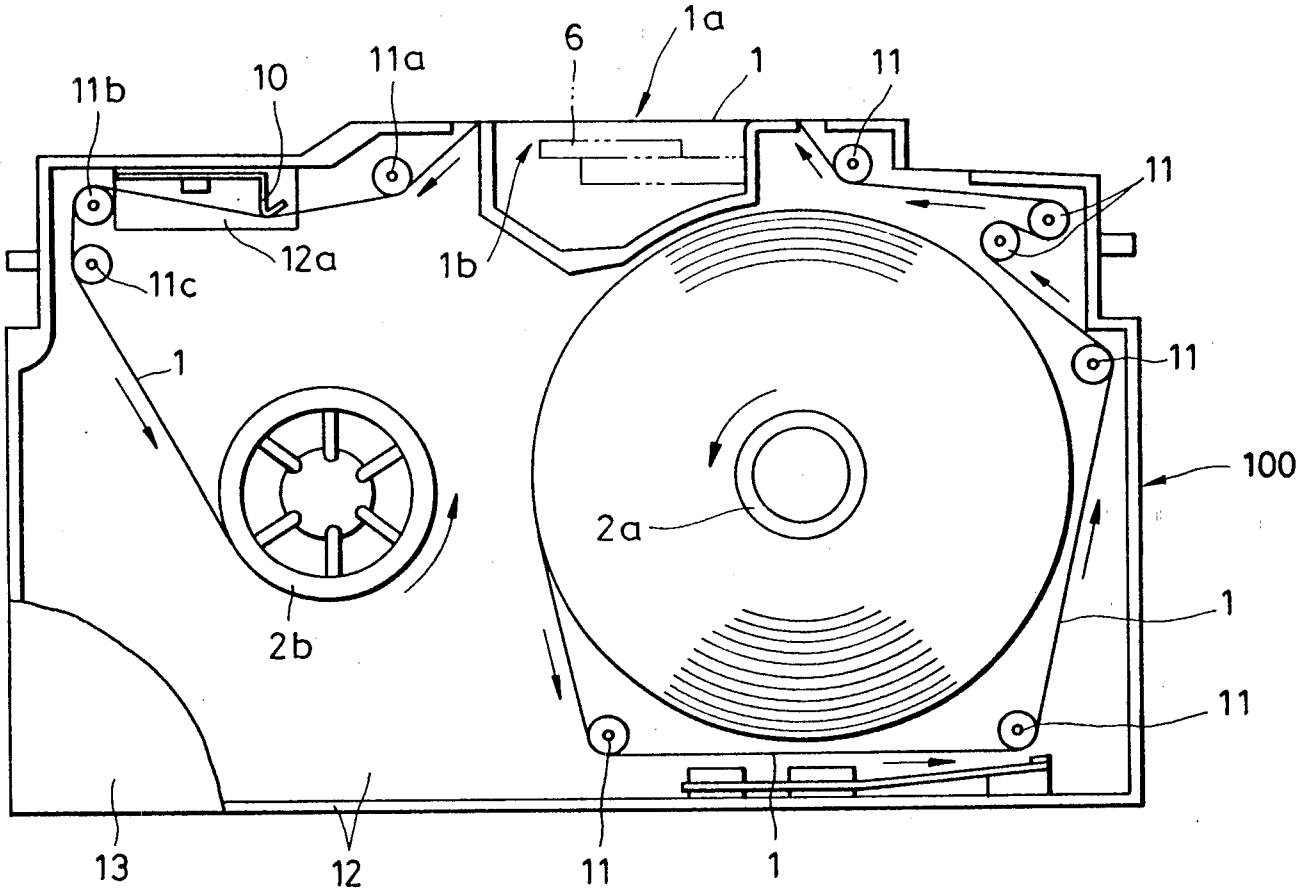
FIG. 2 is a plan view of the ribbon cassette with the upper cover being removed.

Next, the feeding line of the ink ribbon 1 will be described in detail with reference to FIG. 2. First, the ink ribbon 1, wound around the supply reel 2*a*, advances as indicated by the arrows shown in FIG. 2 while it is held in contact with rollers 11. During printing, that portion of the ink ribbon 1 which is out of the ribbon cassette 100 is in contact with the recording head 6 and is heated in accordance with the image signals supplied to the recording head 6. The ink of the heated portions of the ink layer is transferred to the recording paper sheet 7, leaving these ink layer portions void. The ink layer region around these void portions is melted away, causing the ink layer, which comprises a plurality of ink films, to be interrupted. Further, since the layers constituting the ink ribbon 1 are thus melted and mixed with each other, the electrical characteristics of the ink layer surface are changed, improving the conductivity thereof to such an extent that any charge thereon can be dissipated. Afterwards, the ribbon is taken up, along rollers 11*a*, 11*b*, 11*c*, by the take-up reel 2*b*, which engages a take-up axle 17 of carrier 3 (FIG. 1), which is adapted to rotate, by a well-known mechanism, as the carrier 3 moves in the direction b. In this embodiment, a ground plate 10 is provided between the rollers 11*a* and 11*b* in such a manner as to be in contact with the ink layer side surface la of that portion of the ribbon 1 which has undergone the printing process. The ground plate 10 consists of a resilient conductive member, one end portion of which is bent into a V-shape. The crest 10*a* of this V-shaped end portion comes into contact with the ink layer side surface la of the ribbon 1 over the entire width thereof.

As shown in FIG. 3, the ink ribbon 1 has, on the ink layer side la, a number of ink films (four in the example shown), which are formed, one on top of the other, on a base film 1Z. A back surface treating agent 1Y or the like is applied to the back side surface 1*b* of the base film 1Z. In order to make the image at the time of transfer blackish, the ink layer 1X contains a conductive material such as powdered carbon. Here, the construction of the ink ribbon 1 will be described in detail. First, the base film 1Z consists of a polyethylene terephthalate (PET) film having a thickness of approximately 4.5 μm. The back side surface 1*b* of this base film 1Z is coated with silicon resin of a thickness of approximately 1.0 μm as a back surface treatment (A-treatment). The ink layer 1X contains an ethylene-vinyl-acetate copolymer (EVA) and a low-molecular-weight polyvinyl alcohol (PVA) interspersed with carbon black (CB). The material of an insulating layer 1W may be an EvA, a wax, a tackifier, an ionomer resin, a low-molecular-weight polyester, etc.; the insulating layer 1W may consist of one of these materials or a plurality of materials selected from this list in a mixed form. When dried, this insulating layer 1W has a film thickness of approximately 2.5 μm and a volume resistivity of approximately $10^{13}$ to $10^{17}\Omega$cm. Further, a peeling layer containing polyethylene oxide may be provided between the base film 1Z and the ink layer 1X.

In accordance with this embodiment, the ink ribbon 1 after printing is rubbed against the ground plate 10, with the result that that surface portion of the ink ribbon 1 which has undergone the image printing process is scratched off, melted away, or mixed with the lower ink films. It is this surface portion thus rubbed against the ground plate 10 after printing that comes into contact with the ground plate 10, so that, even if the surface layer 1W of the ink ribbon is an insulator, a current path for dissipating charges is formed between the ink ribbon 1 and the ground plate 10, thus allowing the charge on the ink ribbon 1 to flow to the ground plate 10. As a result, the potential of the ink ribbon 1 is equalized with that of the head 6. After dissipating the charge therefrom through the ground plate 10, the ink ribbon 1 is successively taken up by the take-up reel 2*b*.

Figure 4:
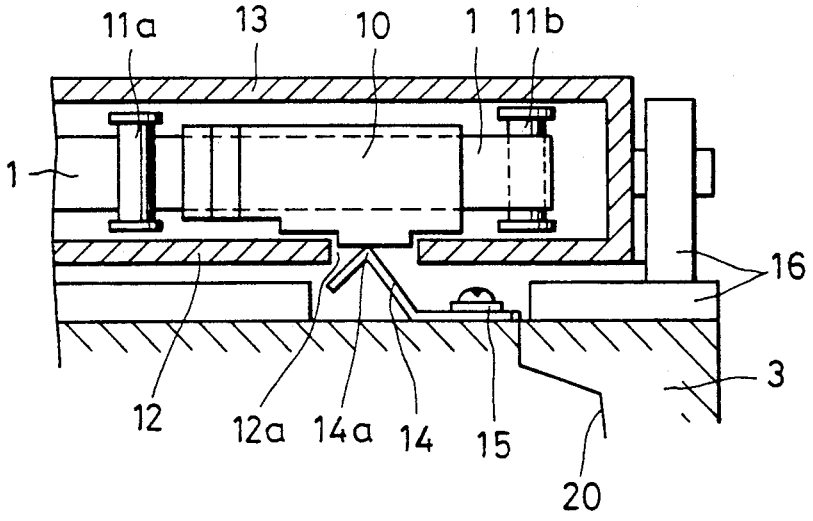
FIG. 4 is a sectional view, as seen in the direction indicated by arrow A of FIG. 1, of the ink ribbon cassette when it is attached to the carrier.
Figure 5:
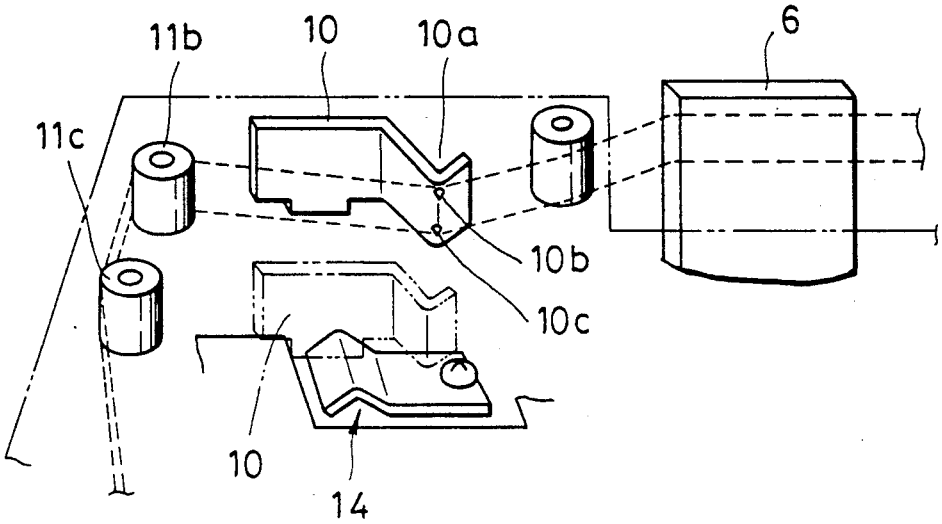
FIG. 5 is an enlarged perspective view showing a part of FIG. 4.

As shown in FIGS. 1, 4 and 5, the carrier 3 is equipped with a ground spring 14, which protrudes slightly from the upper cover 16 of the carrier. More specifically, this ground spring 14 consists of a resilient conductive member, the front end of which is bent to form a V-shaped end portion. The crest 14*a* of this V-shaped end portion protrudes slightly upwards beyond the upper cover 16. When this ribbon cassette 100 is attached to the carrier 3, that portion of the ground plate 10 which is exposed to the exterior through a cutout 12*a*, which is formed in the lower cassette case 12, is brought into contact with the ground spring 14 (this condition is shown in the sectional view of FIG. 4). Reference numeral 13 denotes the upper cassette case. Further, the ground spring 14 is fixed to the carrier 3 by means of a screw 15, which also fixes a conductor 20 to the carrier 3. The conductor 20 is connected to the ground (not shown) of the recording apparatus, so that a discharge current flows from the ink ribbon 1 to the ground of the recording apparatus through the ground plate 10, the ground spring 14, and the conductor 20, thereby dissipating the charge on the ink ribbon 1. As a result, the potential of the ink ribbon 1 is equalized with that of the head, thus preventing the generation of a current which might destroy the head.

Embodiment 2

Although the above embodiment has been described as applied to a serial-type image recording apparatus, it is also applicable to a recording apparatus of the type which employs a line head.

Embodiment 3

While in the above-described embodiment the removal of charge from the ink ribbon is effected in that portion of the ribbon which has undergone the printing process, it is also possible to arrange, in the third embodiment of this invention, the removing of charges in either the ribbon portion which has undergone the printing process or the ribbon portion which has not undergone a printing operation.

In accordance with this embodiment, an electrode which has needle-like projections on its periphery is rubbed against the ink ribbon surface portion which has undergone the printing process or is rubbed against the ink ribbon surface portion which has not been subjected to a printing operation, thereby scratching the ink layer surface. More specifically, as shown in FIG. 5, sharp projections 10*b* and 10*c* are formed on the crest of the V-shaped end portion of the ground plate 10 such that they are pressed against the ink layer of the ink ribbon 1 (in this embodiment, these projections 10*b*, 10*c* are formed as cones each having a bottom surface diameter of approximately 0.5 mm and a height of approximately 0.5 mm). The ground plate or an electrode thus equipped with such projections is rubbed against the ink ribbon 1 to such an extent that the scratches made by the projections 10*b*, 10*c* reach the ink layer 1X of the ink ribbon 1, whose structure is shown in the sectional view of FIG. 3. Since the ink layer 1X has a high conductivity, any charge on the ink ribbon 1 is dissipated through the ground plate 10, the ground spring 14, and the conductor 20. In view of the fact that the projections 10*b*, 10*c* make scars on the ink layer 1X of the ink ribbon 1, it is desirable that the position where the ground plate 10 or the electrode is rubbed against the ink ribbon 1 be carefully selected so that the printing process will not be affected adversely. In the case where the rubbing is effected after printing, however, there is no limitation as to this position. In order to enhance the charge removing effect, two ground plates 10 may be provided such that both the ribbon portion which has undergone the printing process and the ribbon portion which has not been subjected to a printing operation are respectively brought into contact with these ground plates.

Embodiment 4

Figure 6:
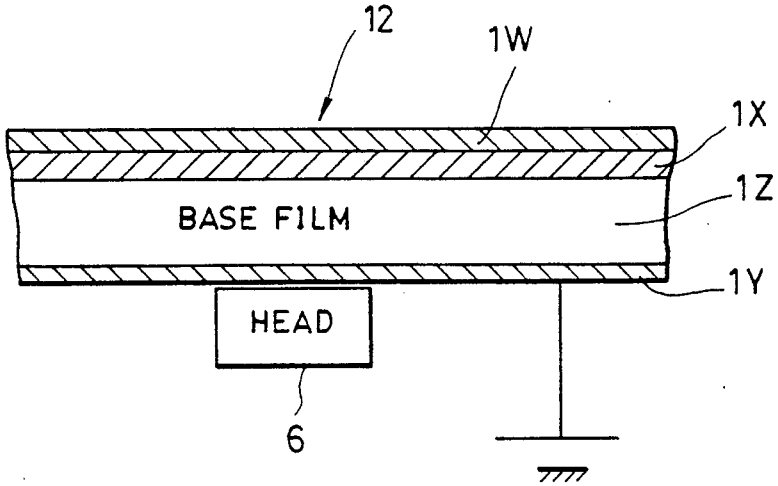
FIG. 6 is a conceptional drawing showing another embodiment of this invention.
Figure 7:
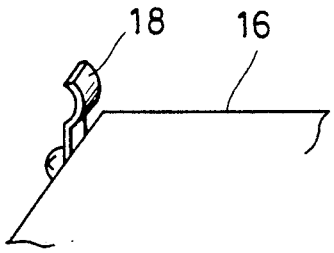
FIG. 7(*a*) is a perspective view of another embodiment showing the essential part of still ground plate 18 on the upper cover 16 of the carrier 3.
Figure 7:
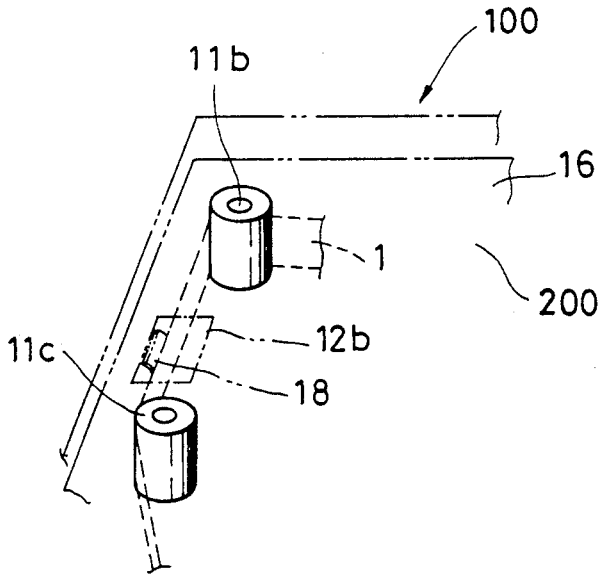

FIG. 6 shows still another embodiment of this invention. This embodiment is particularly advantageous in the case where the surface layer 1W on the ink layer side is an insulator or in the case where a major part or all of the ink films constituting the ink layer are insulators. In accordance with this embodiment, a conductive layer 1Y is formed on that surface of the base film 1Z which is on the head side. This conductive layer is formed by applying a back surface treatment agent to the surface of the base film 1Z which is on the head side (the back surface treatment may, for example, be metal powder coating using powdered iron or the like). Further, as shown in FIG. 7(*a*), a ground spring or plate 18, which is adapted to come into contact with the conductive layer 1Y is upwardly protruding from the carrier 3. Thus, in accordance with this invention, the ground spring 18 can be directly provided on the carrier at a position where it is rubbed against the running ink ribbon 1 somewhere between the rollers 11*a* and 11*b*. In the case of this embodiment, the ground plate 10 and the ground spring 14 are not necessary.

Embodiment 5

A still further embodiment of this invention will be described below.

In the first embodiment, the ground plate or the electrode consists of a conductor made of metal or the like, which is brought into contact with the ink ribbon 1, and the ground plate 10 is provided in the ribbon cassette 100. The reason for this arrangement is that waste ink is apt to gather in the section where the ink ribbon 1 and the ground plate 10 or the electrode are in contact with each other; if this waste ink is an insulator, there is the danger of its being an obstacle to the discharge current path. Accordingly, it is advantageous to provide the ground plate 10 or the electrode in the ribbon cassette 100, which can be replaced with a new one. Conversely, there will be no problems if the ground plate 10 or the electrode is provided on the carrier 3 as long as no waste ink gathers in the section where the ink ribbon 1 and the ground plate or the electrode contact each other or, if so, the waste ink is a conductor. By providing the ground plate or the electrode on the carrier 3, the production cost of the ribbon cassette, which is an article of consumption, can be reduced. The ground plate 10 or the electrode need only to be a good conductor. Therefore, a similar effect can be obtained by a metal roller, which is advantageous in that it reduces the frictional load involved. In view of this, this embodiment as shown in FIG. 7(*b*) adopts the arrangement in which the ground plate 18 is provided not in the ribbon cassette 100 but on the upper cover 16 of the carrier 3 at a position where it is rubbed against the ink ribbon between the rollers 11*b* and 11*c*, as in the foregoing embodiment shown in FIG. 7(*a*). In accordance with this arrangement, the ground plate 18 enters the cassette 100 through the cutout 12*b* formed in the lower cassette case 12, as shown in FIG. 7(*b*), and is rubbed against the ink ribbon 1, discharging the charge on the ink ribbon 1 to the ground. In this embodiment, the ground plate 18 may abut against either the insulating layer 1W of the ink ribbon 1 or the back surface of the same. In terms of the context of the foregoing embodiments, the arrangement in which the ground plate 18 abuts against the ink layer side of the ribbon may 1 be regarded as a modification of the embodiment shown in FIG. 1. Likewise, the arrangement in which it abuts against the back surface of the ink ribbon 1 may be regarded as a modification of the embodiment shown in FIG. 6.

In the above-described embodiments, the material of which the ground plate or the electrode is composed may, for example, be phosphor bronze, copper, gold, stainless steel, aluminum, a conductive plastic, etc. The electrical resistance of the ground plate or the electrode may be 1kΩ or less, and preferably 100Ω or less, and most preferably, 10Ω or less.

Thus, in accordance with this embodiment, the ground plate or the electrode for dissipating the charge on the ink ribbon 1 is in contact with a conductive layer of the ribbon, so that the charge can flow to the ground of the recording apparatus. Therefore, in accordance with this embodiment, deleterious electrochemical reactions in the head electrode section can be prevented even if the ink layer side surface of the ink ribbon 1 has an insulating characteristic, thus providing a recording apparatus, the recording head of which is protected from destruction.

As described above in detail, this invention can provide an ink ribbon cassette and a recording apparatus which make it possible to produce clear recording.

What is claimed is:

1. An ink ribbon cassette adapted to be attached to a recording apparatus, said ink ribbon cassette comprising:

an ink ribbon having an ink layer and an electrically insulating surface layer;

a first winding section around which said ink ribbon can be wound;

a second winding section around which said ink ribbon can be wound; and a conductive member positioned to contact with said ink ribbon, to form an electrical connection with the ink layer, wherein when said ink ribbon cassette is attached to the recording apparatus, said ink ribbon is subjected to a recording action from the recording apparatus, wherein said conductive member is positioned downstream of a recording head of the recording apparatus when said cassette is attached to the recording apparatus.

2. An ink ribbon cassette according to claim 1, wherein said insulating surface layer has a volume resistivity of $10^{13}$ to $10^{17}\Omega$cm.

3. An ink ribbon cassette according to claim 1, wherein said conductive member has an electrical resistance of no greater than 1kΩ.

4. An ink ribbon cassette according to claim 1, wherein said conductive member has an electrical resistance of no greater than 100Ω.

5. An ink ribbon cassette according to claim 1, wherein said conductive member has an electrical resistance of no greater than 10Ω.

6. An ink ribbon cassette according to claim 1, wherein said conductive member comprises means for grounding said ink ribbon when said ink ribbon cassette is attached to the recording apparatus.

7. An ink ribbon cassette according to claim 1, wherein said conductive member is positioned to engage a conductive member in the recording apparatus when said ink ribbon cassette is attached to the recording apparatus.

8. An ink ribbon cassette for attachment to a recording apparatus which performs recording on a recording medium, said ink ribbon cassette comprising:

an ink ribbon having an insulating surface layer;

a first winding section around which said ink ribbon can be wound;

a second winding section around which said ink ribbon can be wound; and an electrode for dissipating electrical charges which is arranged in such a manner as to come into contact wit the ink surface of that portion of said ink ribbon which is between said first and second winding sections, wherein said electrode is positioned downstream of a recording head of the recording apparatus when said cassette is attached to the recording apparatus.

9. An ink ribbon cassette according to claim 8, wherein said electrode comprises means for grounding said ink ribbon when said ink ribbon cassette is attached to the recording apparatus.

10. A recording apparatus adapted to perform recording on a recording medium, comprising:

a recording apparatus body;

an attachment section which allows detachable attachment of an ink ribbon cassette including an ink ribbon having an ink layer and an insulating surface layer, a first winding section around which said ink ribbon can be wound, a second winding section around which said ink ribbon can be wound, and an electrode for dissipating electrical charges which is arranged in such a manner as to come into contact with that portion of the ink layer side surface of said ink ribbon which is between said first and second winding sections;

an apparatus body side electrode adapted to abut against the electrode of the ink ribbon cassette and to dissipate electrical charges of the ink ribbon when said ink ribbon cassette is attached to said attachment section; and a recording head which can act on the ink ribbon in the ink ribbon cassette when the ink ribbon cassette is attached to said attachment section, wherein said recording head is positioned upstream of the ink ribbon cassette electrode when said attachment section attaches the ink ribbon cassette to said recording apparatus.

11. A thermal recording apparatus according to claim 10, wherein said electrode has an electrical resistance of no greater than 1kΩ.

12. A thermal recording apparatus according to claim 10, wherein said electrode has an electrical resistance of no greater than 100 Ω.

13. A thermal recording apparatus according to claim 10, wherein said electrode has an electrical resistance of no greater than 10 Ω.

14. An ink ribbon cassette adapted to be attached to a recording apparatus, said ink ribbon cassette comprising:

an ink ribbon having an ink layer and an electrically insulating surface layer;

a first winding section around which said ink ribbon can be wound;

a second winding section around which said ink ribbon can be wound; and a conductive member positioned to contact said ink ribbon, to form an electrical connection with the ink layer, wherein said conductive member is positioned. downstream of a recording head of the recording apparatus with respect to the feeding direction of said ink ribbon in performing recording when said cassette is attached to the recording apparatus.

15. An ink ribbon cassette according to claim 14, wherein said insulating surface layer has a volume resistivity of $10^{13}$ to $10^{17}\Omega$cm.

16. An ink ribbon cassette according to claim 14, wherein said conductive member has an electrical resistance of no greater than 1kΩ.

17. An ink ribbon cassette according to claim 14, wherein said conductive member has an electrical resistance of no greater than 100 Ω.

18. An ink ribbon cassette according to claim 14, wherein said conductive member has an electrical resistance of no greater than 10 Ω.

19. An ink ribbon cassette according to claim 14, wherein said conductive member comprises means for grounding said ink ribbon when said ink ribbon cassette is attached to the recording apparatus.

20. An ink ribbon cassette according to claim 14, wherein said conductive member is positioned to engage a conductive member in the recording apparatus when said ink ribbon cassette is attached to the recording apparatus.

21. An ink ribbon cassette for attachment to a recording apparatus which performs recording on a recording medium, said ink ribbon cassette comprising:

an ink ribbon having an insulating surface layer;

a first winding section around which said ink ribbon can be wound;

a second winding section around which said ink ribbon can be wound; and an electrode for dissipating electrical charges which is arranged in such a manner as to come into contact with the ink layer of said ink ribbon which is between said first and second winding sections, wherein said electrode is positioned downstream of a recording head of the recording apparatus with respect to the feeding direction of said ink ribbon in performing recording when said cassette is attached to the recording apparatus.

22. An ink ribbon cassette according to claim 21, wherein said electrode comprises means for grounding said ink ribbon when said ink ribbon cassette is attached to the recording apparatus.

23. A recording apparatus adapted to perform recording on a recording medium using an ink ribbon cassette including an ink ribbon having an ink layer and an insulating surface layer, a first winding section around which said ink ribbon can be wound, a second winding section around which said ink ribbon can be wound, and an electrode which is arranged in such a manner as to come into contact with the ink layer of said ink ribbon, said electrode being disposed between said first and second winding sections, said recording apparatus comprising:

an attachment section allowing detachable attachment of the ink ribbon cassette;

an apparatus body side electrode adapted to abut against the electrode of the ink ribbon cassette and to dissipate electrical charges on the ink ribbon when said ink ribbon cassette is attached to said attachment section; and a recording head which can act on the ink ribbon in the ink ribbon cassette when the ink ribbon cassette is attached to said attachment section, wherein said recording head is positioned upstream of the ink ribbon cassette electrode with respect to the feeding direction of the ink ribbon in performing recording when said attachment section attaches the ink ribbon cassette to said recording apparatus.

24. A thermal recording apparatus according to claim 23, wherein said electrode has an electrical resistance of no greater than 1kΩ.

25. A thermal recording apparatus according to claim 23, wherein said electrode has an electrical resistance of no greater than 100 Ω.

26. A thermal recording apparatus according to claim 23, wherein said electrode has an electrical resistance of no greater than 10 Ω.

27. A method for dissipating electrical charges of an ink ribbon in an ink ribbon cassette used in a recording apparatus, in which ink or an ink layer of the ink ribbon is transferred to a recording medium by heat from a recording head, so that recording is performed, comprising the steps of:

attaching the ink ribbon cassette to the recording apparatus;

performing recording with a recording head of the recording apparatus and the ink ribbon and feeding the ink ribbon in a feeding direction; and contacting a conductive member of the ink ribbon cassette to an ink layer of the ink ribbon downstream of the recording head in the ink ribbon feeding direction, so that electrical charges of the ink ribbon are dissipated.

28. A method according to claim 27 further comprising the steps of:

providing an electrically insulating surface layer on the ink ribbon; and exposing the ink layer through the electrically insulating surface layer during recording or with the conductive member to perform said contacting step.

29. A method according to claim 28, wherein said insulating surface layer has a volume resistivity of $10^{13}$ to $10^{17}$Ωcm.

30. A method according to claim 27, wherein the conductive member has an electrical resistance of no greater than 1kΩ.

31. A method according to claim 27, wherein the conductive member has an electrical resistance of no greater than 100 Ω.

32. An ink ribbon cassette according to claim 27, wherein the conductive member has an electrical resistance of no greater than 10 Ω.

33. A method according to claim 27, wherein said contacting step comprises the step of grounding the ink ribbon.

34. A method according to claim 27, further comprising the step of contacting the conductive member of the ink ribbon cassette to a conductive member of the recording apparatus after said attaching step.

* * * * *

UNITED STATES PATENT AND TRADEMARK OFFICE

CERTIFICATE OF CORRECTION

PATENT NO. : 5,306,097

DATED : April 26, 1994

INVENTOR(S) : MASANORI KANEKO

It is certified that error appears in the above-indentified patent and that said Letters Patent is hereby corrected as shown below:

COLUMN 2

Line 38, "allows" should read -- allows attachment --.
Line 53, "recording-" should read -- recording --.
Line 61, "the the" should read -- the --.

COLUMN 5

Line 68, "EvA," should read -- EVA, --.

COLUMN 9

Line 41, "wit" should read -- with --.

UNITED STATES PATENT AND TRADEMARK OFFICE

CERTIFICATE OF CORRECTION

PATENT NO. : 5,306,097

DATED : April 26, 1994

INVENTOR(S) : MASANORI KANEKO

It is certified that error appears in the above-indentified patent and that said Letters Patent is hereby corrected as shown below:

COLUMN 10

Line 31, "tioned." should read -- tioned --.

COLUMN 12

Line 17, "claim 27" should read -- claim 27, --.

Signed and Sealed this

Twenty-fifth Day of October, 1994

*Attest:*

*Attesting Officer*

BRUCE LEHMAN

*Commissioner of Patents and Trademarks*